United States Patent [19]

Becker et al.

[11] 4,446,848

[45] May 8, 1984

[54] FIREPLACE INSERT CONSTRUCTION

[75] Inventors: William M. Becker; William R. Becker, both of Smithville, Mo.

[73] Assignee: Gladstone Furnace Company, Inc., Kansas City, Mo.

[21] Appl. No.: 492,558

[22] Filed: May 9, 1983

[51] Int. Cl.[3] ..... F24B 7/00

[52] U.S. Cl. ..... 126/121; 126/131; 126/138

[58] Field of Search ..... 126/121, 131, 129, 138; 237/51

[56] References Cited

U.S. PATENT DOCUMENTS

| | | | |
|---|---|---|---|
| 1,309,024 | 7/1919 | Forbes | 126/131 |
| 3,880,141 | 4/1975 | Abshear | 126/121 |
| 4,042,160 | 8/1977 | Ickes | 126/121 |
| 4,178,908 | 12/1979 | Trexler, Sr. | 126/121 |
| 4,231,349 | 11/1980 | Livesay | 126/121 |
| 4,303,056 | 12/1981 | Slavik et al. | 126/121 |
| 4,357,930 | 11/1982 | Eberhardt | 126/121 |

FOREIGN PATENT DOCUMENTS

| | | | |
|---|---|---|---|
| 737465 | 12/1952 | United Kingdom | 126/121 |

*Primary Examiner*—Larry Jones

*Attorney, Agent, or Firm*—Thomas M. Scofield

[57] ABSTRACT

Improvements in fireplace heaters or devices for efficiently extracting heat from a conventional fireplace; a fireplace enclosure with novel heat exchange and absorption means; a prefabricated installation for use in a conventional fireplace to obtain the maximum utilization of the heat generated by wood, coal or other combustion in a conventional fireplace; a fireplace screen incorporating a forced air draft system associated with a heat absorbing plenum unit and exchanger associated therewith; a forced air fireplace heating system with complete draft control.

12 Claims, 18 Drawing Figures

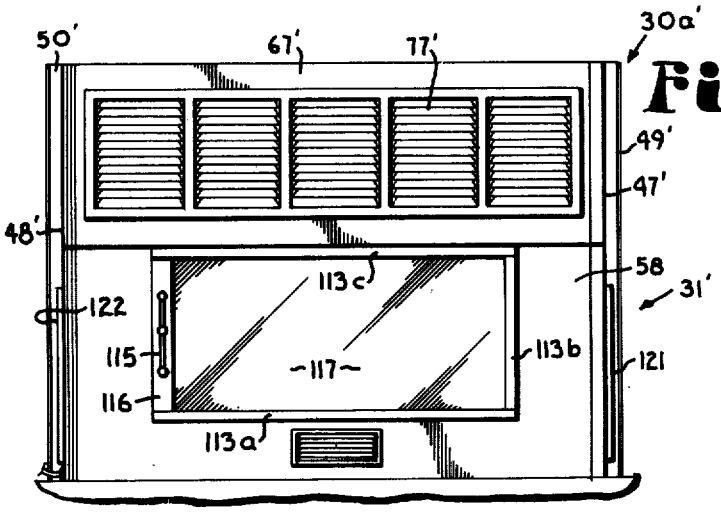
Fig. 14.
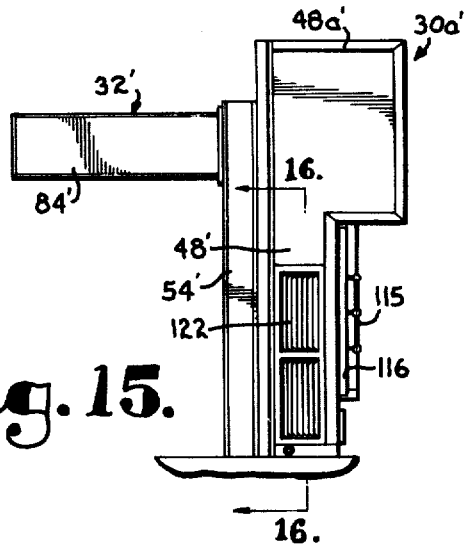
Fig. 15.
Fig. 16.
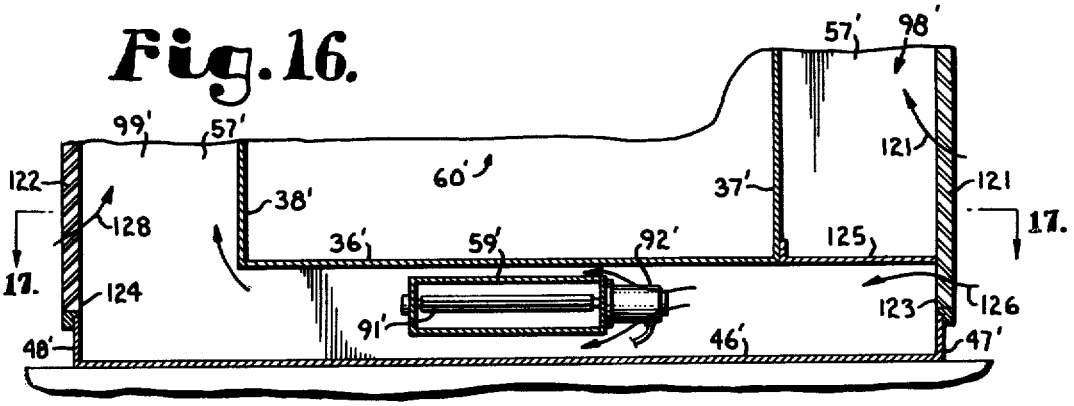
Fig. 17.
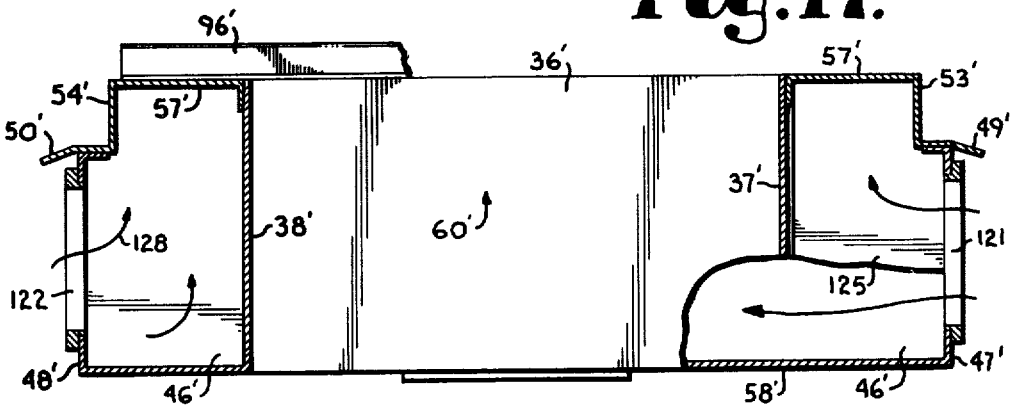

FIREPLACE INSERT CONSTRUCTION

BACKGROUND OF THE INVENTION

It is universally known that the heating efficiency of the conventional fireplace (wood, charcoal or coal burning, typically) is extremely low. A great deal of the combustion heat is largely lost up the chimney in the form of combustion gases, smoke and vapors, as well as heated convection currents. Next, the necessary combustion draft into the fireplace and up the chimney must draw cold air from outside the dwelling into the house and the room housing the fireplace through various openings in the structural members of the dwelling, including door frames, window casings and the like. The radiation from the five alone often serves as the primary source of room heat.

A considerable number of devices and constructions have been developed in the past, utilized and are presently available on the market in various forms to attempt to improve the effectiveness and efficiency of fireplace heating and the achievement of more efficient use of the combustion energy of fuel. With the prices of natural gas, fuel oil, coal and wood all skyrocketing and multiplying, the problem of efficient fuel and energy utilization has become a most serious business indeed. In dwellings which have fireplaces and where such fireplaces are used as auxiliary, supplemental or even primary sources of heat for the dwelling or portions thereof, it is clearly necessary to increase the efficiency of fireplaces by extracting more of the waste heat and circulating it into the room in which the fireplace is located and the balance of the house.

It is not unusual to find dwellings with a conventional central heating system of the forced air type, one or more wood or coal burning stoves and one or more fireplaces. Each of these heat sources has been the subject of intense analytical and cirtical study to attempt to improve the efficiency, as well as safety, of their use. This particular invention is directed specifically to fireplaces wherein there is provided a recessed chamber, typically within the wall of a room of a dwelling, the chamber being constructed of and lined with fire resistent materials, there being a flue at the upper and rear portion of the fireplace chamber, with damper control of air moving from the fireplace chamber into the flue, the flue communicating with a chimney or exhaust channel.

It is understood, as noted, that various fuels are employed in fireplaces, particularly wood, per se, powdered and compressed wood, charcoal, coal and the like. A grate construction is typically provided within the fireplace to contain the fuel to be burned, the grate spacing the fuel members, pieces and chunks upwardly from the floor of the fireplace chamber to enable air circulation through the combustion fuel and, as well, permit accumulation of residue and ash therebelow in such a manner as to not impede the burnout of the original charge of materials, as well as cleanout of the fireplace before the next charge of combustible materials. Improvements have been made in grate constructions to arrange fuels of various sorts for the most efficient combustion and effective production of heat, particularly radiant heat, into the room.

It has come to be recognized as general principles, in dealing with fireplace fuel combustion, that certain control measures, as well as structural provisions, increase efficiency of energy use. In the first place, it is advantageous to close the front of the fireplace with a transparent cover in order to control the access of air from the room containing the fireplace into the fireplace compartment or chamber. Secondly, the inflow of air from the room or space containing the fireplace must be controlled to regulate the quantity of combustion which takes place in the fireplace. Thirdly, mechanical structures involving hollow tubes, passageways and compartments may be placed within the fireplace chamber or compartment in various arrays and positions in order to absorb some of the heat of the fire. Air from the room or liquids may be circulated through these pipes, tubes, constructions and the like to transfer the absorbed heat into the space which is desired to be heated by the fireplace.

Nevertheless, despite the development of these adjuncts and accessories to fireplace structure and use, the most efficient manner and means for maximizing the control of energy produced by a fire in a fireplace has not yet been provided. This goal, so intensely important and significant to the present society, as well as the future, in the subject of this invention.

Three of the most commonly used forms of heating living and dwelling spaces are forced air furnace systems, wood and coal burning free standing stoves and fireplaces. With respect to the combustion carried out in each of these systems, there is provided a flue carrying off the combustion gases. Such combustion gases must be removed from the living and dwelling space because they are dangerous to life. Means have previously been sought to safely extract lost quantities of heat from these combustion gases in order to make the actual heating of the living space in question more efficient.

For example, it is known to jacket the flue conduits carrying the hot exhaust gases and combustion products and flow heat exchanging fluid therethrough. It is additionally known to interpose some heat absorbing object or structure in the flow path of the hot exahust gases in such conduits to extract some fraction of the waste energy therefrom. Heat gathered in the fluid passing through the conduit jacket or heat exchanging structure or barrier in the conduit is passed back into the room, dwelling space or basement where the heating device is located, typically carried by the fluid.

The heat exchanging medium which has picked up some of the excess heat from the combustion gases may be ambient air circulated from the room containing the heating device and recycled back thereto. If the heat exchanging fluid or medium is liquid, it may transfer heat back to the desired zone through fin type heat exchangers over which interior zone air is moved or blown. In forced air furnace systems heat may be transferred into the furnace air return ducts.

The subject invention is devoted to the extraction of maximum heat from a conventional fireplace while coupling such action and effect with the actual control and manipulation of the combustion in the fireplace so as to maximize efficiency of combustion and minimal use of fuel as well as extraction of heat in a useful manner therefrom.

THE PRIOR ART

Applicant is aware of the following prior art patents which are directed to structures and processes for attempting to achieve some or all of the goals and objects of the subject development and improvements. These patents are listed in chronological order of issue.

Modine, "Fireplace Heater", U.S. Pat. No. 2,052,643, issued Sept. 1, 1936.

Harris U.S. Pat. No. 2,196,795 "Fireplace Heater Attachment", issued Apr. 9, 1940.

Brooks U.S. Pat. No. 2,359,197 "Fireplace Heater" issued Sept. 26, 1944.

Asbury U.S. Pat. No. 2,787,997 "Oil Burning Room Heater", issued Apr. 9, 1957.

Snodgrass U.S. Pat. No. 2,828,078 "Hearth Heater", issued Mar. 25, 1958.

Pellegrino et al U.S. Pat. No. 3,453,737, issued July 1, 1969 for "Fireplace Control . . . Unit".

Lydie U.S. Pat. No. 3,870,032 "Fireplace Front Or Screen", issued Mar. 11, 1975.

Breen et al U.S. Pat. No. 3,976,047, issued Aug. 24, 1976 for "Heat Exchanger".

Stites U.S. Pat. No. 3,901,212, issued Aug. 26, 1975 for "Fireplace Heat Extractor".

Miller U.S. Pat. No. 3,930,491, issued Jan. 6, 1976 "Combination Fireplace And Space Heater".

Soeffker U.S. Pat. No. 3,955,533, issued May 11, 1976 for "Auxiliary Heater For Fireplaces".

Brown U.S. Pat. No. 4,112,914 issued Sept. 12, 1978 for "Combined Fireplace Hood And Heating Unit".

Slavik U.S. Pat. No. 4,112,915, issued Sept. 12, 1978 for "Fireplace Enclosure With Heat Exchanger".

Borgran U.S. Pat. No. 4,122,824, issued Oct. 31, 1978 for "Device For Extracting Heat From A Fireplace."

Livesay U.S. Pat. No. 4,231,349, issued Nov. 4, 1980 for "Fireplace Heat Exchanger Unit".

Perry U.S. Pat. No. 4,282,855, issued Aug. 11, 1981 for "Fireplace Screen System".

Lehrer U.S. Pat. No. 4,297,986, issued Nov. 3, 1981 for "Forced Air Fireplace Heating System".

Thurlo U.S. Pat. No. 4,319,558, issued Mar. 16, 1982 for "Fireplace Heater".

OBJECTS OF THE INVENTION

A first object of the invention is to provide new and substantial improvements and results in fireplace heaters, forced air fireplace heating systems, fireplace heat exchanger units, devices for extracting heat from fireplaces, fireplace enclosures with associated heat exchangers, auxiliary heaters for fireplaces, heat extracters from fireplaces, fireplace combustion control devices and the like.

Another object of the invention is to provide such improvements, devices, processes and systems wherein energy extraction from fireplace construction is maximized over the best known related type constructions, known in the prior art, while still preserving the natural beauty and attractiveness of a fireplace as conventionally used in a home or other dwelling or living space.

Another object of the invention is to provide such improvements, devices, systems and processes, as well as controls therefor, wherein not only is energy extraction maximal and optimum, but safety considerations are always primary and effective.

Yet another object of the invention is to provide such improvements, devices, systems and processes in such form as to be able to effectively fit, (with miminal adjustment and modification, as well as required substitution of parts) substantially all fireplaces of conventional dimensions. Unusually constructed or very differently sized fireplaces are convertible by custom made units with a minimum of expense.

Another object of the invention is to provide a fireplace insert construction of extremely strong, durable, simple and long lived structure and nature which will produce optimum and maximal results and heat extraction over long periods of time with minimum requirements of replacement and repair of parts.

Another object of the invention is to provide a fireplace insert construction of the character described fully adapted to produce the results noted, stated and claimed which is easily and readily inserted and mounted in the fireplace, as well as extracted therefrom, when necessary, for full access to the fireplace should reconstruction, repair or the like be necessary to either the insert or the fireplace itself.

Another object of the invention is to provide a device of the character described which is relatively simple in construction, composed and built of the most durable and lasting materials, wherein the service desired and expected of the unit, as well as its efficiency and effectiveness, will be provided over an extremely long interval of time despite heavy and continued use.

Another object of the invention is to provide such a fireplace insert device of the character described which meets the requirements for an efficient fireplace energy extractor over and beyond the capacities and abilities of all of the prior art devices known to the art and available on the market.

Another object of the invention is to provide such a device of the character described which is commercially practical for the first time, both with respect to manufacture and installation, were extreme compactness, superiority of design and effectiveness of use enable the achievement of the goal of an efficient fireplace for the first time in history on a practical, individual, commercial basis, as opposed to a theoretical and hypothetical goal or desire.

Still another object of the invention is to provide a fireplace insert and energy extracter of the character described wherein the facade of the device, as presented to the living space, room or dwelling in which the device is used or installed, in a fireplace, is of extreme attractiveness both inherently in its own design and with respect to the fire combustion which takes place behind the front screen and fireplace space closure thereof.

Another object of the invention is to provide such a fireplace insert wherein the goals of combustion control in the fireplace itself and maximum extraction of energy from the fire as it burns are both achieved in complete cooperation with one another, whereby to achieve the long sought goal of most efficient heat and energy extraction from a fireplace.

Another object of the invention is to provide such control systems associated with a fireplace insert of the character described as to most efficiently manage the use of the device in cooperation with the burning of the fire to achieve all the goals, including safety features, envisioned, desired and projected (yet not heretofore achieved) by prior art devices and systems.

Still another object of the invention is to provide a device of the character described which incorporates elements, constructions and devices to protect the fireplace insert as a whole (and particularly the parts thereof which are exposed to the greatest heat in the fireplace combustion process) in such manner as to prevent deterioration, damage or destruction to the operating parts thereof.

Yet another object of the invention is to provide such a fireplace insert with means for completely controlling combustion and effective energy extraction therefrom, while providing adequate access to the fireplace chamber or compartment for charging of the fireplace and the fuel holder or grate therein with fuel before a fire and, further, cleaning the fireplace after the fire has been burned therewithin.

Other and further objects of the invention will appear in the course of the following description thereof. In the drawings, which form a part of the instant specification and are to be read in conjunction therewith, embodiments of the invention are shown and, in the various views, like numerals are employed to indicate like parts.

DESCRIPTION OF THE DRAWINGS

FIG. 14 is a front perspective view of a modified form of the subject device wherein the air intakes are positioned laterally of the frame of the device, rather than on the lower front thereof as seen in the previous figures (and particularly in FIGS. 1, 3, 5 and 8).

FIG. 15 is a side view of the device of FIG. 10, essentially like the view of FIG. 2, this view showing, in addition to the laterally positioned air intakes, a side view of the preferred form of the door illustrated in FIGS. 12 and 13.

FIG. 16 is a view taken along the line 16—16 of FIG. 15 in the direction of the arrows.

FIG. 17 is a view taken along the line 17—17 of FIG. 14 in the direction of the arrows.

INSTALLATION, OPERATION AND MAINTENANCE

Figure 1:
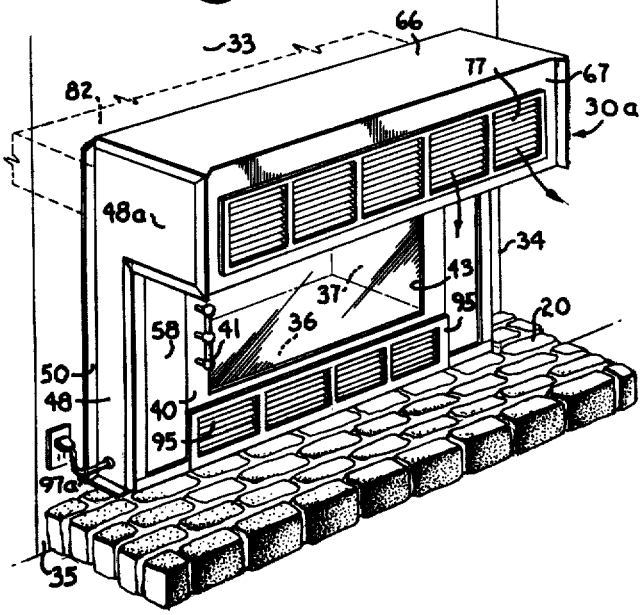
FIG. 1 is a three quarter perspective view of a first form of the device and subject invention taken from the front and above with the device shown installed in a fireplace of conventional construction.

Before installation of the subject device takes place, the fireplace, per se, the fire box of the fireplace, the flue, the hearth, the face of the fireplace and all associated and functioning parts of the fireplace must be in absolutely first class, clean condition and, as well, in A-1 operating condition without malfunctions or defects. If the basic fireplace and accessory structures and devices are not in proper structural the working condition, the subject device should not be installed until such conditions are all remedied.

It is most important that the heat exchanging plenum at the rear of the subject device (which inserts back into the fireplace fire box) be of the proper size in order that the necessary, specified and proper clearance between the periphery of this plenum box or chamber and the fireplace fire box be present. Without the stated necessary and proper clearance, the necessary and proper air draft will not be present. With excess clearance, inefficient operation will be the case. The proper rear plenum box size for the specific fireplace must and should be obtained.

The entire front, outer frame and the upper, rear and side fireplace inserts of the subject device must so fit within (and also outside of the fireplace front face and surface) that full and proper circumferential installation of the device inside the fire box and at the fireplace face can be accomplished, as illustrated in the subject drawings.

Before the device is installed into a given fireplace, the existing draft must be set at full open or sufficiently wide open to give a good, solid air draw through the flue. For initial, untested applications, the existing draft should be set wide open.

Once the device has been inserted into a fireplace and it has been ascertained that the device is properly sized internally and externally from the fireplace, then, to fix the device in place, the position securement bolts which are supplied with the device must be applied between the bracket attachment on the rear wall of the top frame and the fire box wall. The installation operator may reach in through the access opening, after opening the door, and screw into engagement the bolts on each side of the rear of the device opposite the top of the opening.

The wall thermostat is attached adjacent the fireplace, but not on the fireplace brick or facing. Upon plugging the device power plug into a conventional 110 volt AC socket, the device is ready for operation. Note: The subject device, as fitted with the controls described, will not operate in the manner specified without power supply as indicated.

OPERATION AFTER INSTALLATION

Periodic ash buildup must be removed from the fireplace in conventional manner through the door and access opening. Charging of starting materials and wood should not be made except into a clean, orderly fireplace compartment.

One turns the thermostat setting above the room temperature in order to open the draft.

It is recommended that initial and periodic use of a known and established chemical soot and rosin remover be undertaken according to the directions given by the manufacturer thereof. This use will aid in minimizing any problem with soot and rosin buildup and any possible unpleasant consequences deriving therefrom.

To start a fire, the grate is padded with suitably prepared newspaper in rolled up and crumpled form and, thereafter, logs are laid thereover for initial combustion in the usual fire starting position or array. With match or firestarter (preferably do not use any chemical fire starter), ignite the paper. Close the door of the device. The fireplace and fireplace insert drafts both should be open wide at this point.

Once the fire has started and is successfully burning, set the room thermostat to the desired temperature and the device draft will open and close according to the ambient room temperature.

As the fuel supply burns out, open the door of the insert and add limited quantities of fuel in such manner as to maintain the fire in best operating condition.

As the fire making season wears on, periodic checks with respect to whether carbon, soot or rosin buildup is occurring should be made by the dwelling owner. Failure to check and take appropriate steps can result in unplanned firebox fires, flue fires and even serious house fires, should there be a failure in the fireplace structure or system.

Except for adding wood or fuel, readjusting the position of wood or fuel in the grate, or cleaning out the fireplace, the main door is always closed on the fireplace insert.

To damp down or put out the fire, turn the thermostat to the lowest setting. This will close the damper and the fire will smother out, in due course.

FIGS. 1–6, Inclusive—Structure And Function

Figure 2:
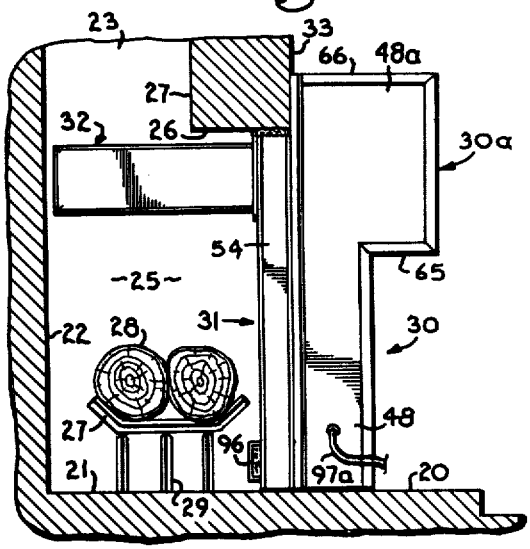
FIG. 2 is a sectional view taken through a fireplace from the side, showing the device of FIG. 1 installed therewithin.

The views of the first form of device particularly illustrated in FIGS. 1–8, inclusive show the fireplace insert heat exchanger received within a conventional fireplace. Referring particularly to FIG. 2, but also the other figures, this fireplace has a hearth surface 20, normally horizontal, which leads rearwardly into the fireplace compartment or chamber as floor 21. Rear inward wall 22 of the fireplace typically leads upwardly to a flue passage 23 which then passes to a chimney or other outside access for the combustion gases, smoke, etc. of the fire. The fireplace compartment additionally is defined by normally vertical side walls 24 and 25 (FIGS. 6–8, inclusive with there being the top wall 26, normally horizontal, which leads back to vertical wall 27 which is one of the walls (with the upward extensions of side walls 24 and 25 and rear wall 22) which define the flue passage. It is understood that, aside from the fireplace compartment floor 21, which is generally horizontal and flat, the side and rear walls may be substantially vertical as shown or converged together at the upper portion of the fireplace compartment, be inclined somewhat from the vertical or take various configurations.

The purpose of the fireplace compartment is to provide a recess which is lined with fire resistant materials, there being an opening into the room or living space from the fireplace and an upper exhaust flue through which the undesirable combustion products, smoke, etc. will exit under the normal draft of a conventional fireplace. A damper construction (not seen) is typically provided located slightly upwardly in the flue 23 or at its lower terminus to enable the opening, closing or adjustable sizing of the opening of the flue passageway to provide the optimum draft conditions in a fire.

Most conventionally, the opening into the fireplace compartment or chamber is rectangular in character, being defined by floor 21, side walls 24 and 25 and top wall 26. A grate or fuel support platform 27 is conventionally provided which may be a metal frame platform to receive log or coal pieces 28, the platform being spaced upwardly from floor 21 by legs 29. The latter offers the opportunity for the air draft in normal combustion to come in under the fire for good combustion action and also provides a space for ash and embers to collect as the fire proceeds.

Sections and perspectives of typical fireplace constructions of varying configuration are shown in numerous of the prior art patents hereabove listed and the disclosures of coventional fireplaces and their configurations, typical damper configurations and such are here incorporated by reference as background information. It should be noted that, while the best known domestic fireplace construction is one recessed in a wall (often through the wall with the chimney integral therewith), inward, fully indoor constructions such as seen in Ballinger U.S. Pat. No. 2,429,748, issued Oct. 28, 1947 "Fireplace Construction", as well as internal wood burning stove constructions which have the grate largely surrounded by a fire resistant wall are all suitable for use of the subject invention, provided there is a suitable opening for insertion of the subject construction.

The subject device basically involves a housing construction (particularly see FIG. 2 for this initial board characterization of parts) which is adapted to be positioned over and based on the hearth 20 at a fireplace opening with (1) certain parts of the device positioned exteriorly of the fireplace chamber or compartment, per se, (2) a portion thereof fitting closely within the fireplace opening to be sealed therearound and (3) a plenum chamber fixed to the latter inwardly mounted part of the housing which extends inwardly of the fireplace compartment above the floor 21 thereof, as well as above the grate 27 and fuel 28 therewithin. These noted parts, for purpose of initial description, and referring to particularly FIG. 2, are generally designated 30 for the lower external portion of the housing, **30*a* for the upper external portion thereof, 31 for the internal, inwardly fitting portion of the housing and 32 for the plenum box or chamber. The same arrangement of elements may readily be seen in FIG. 15 where a somewhat modified form of the device is shown in the same view as in FIG. 2**, but without showing the fireplace structure surrounding same.

For descriptive purposes (particularly see FIGS. 1–3, inclusive), the fascade or front walls of the fireplace surrounding the fireplace opening are designated 33 above the fireplace opening, 34 to the right of the fireplace opening facing the opening and 35 to the left of the fireplace opening.

When one provides an insert which blocks off the entirety of the opening into a fireplace, it is necessary to provide in such insert, however the insert may function, an opening and passage therethrough to give access to the fireplace compartment in order that fuel may be charged to the compartment and piled on the grate as seen in FIG. 2, for example and, secondly, in order that the fireplace compartment can be cleaned of ashes, etc. when necessary. Some fireplaces have floor ash disposal openings and systems which are not incompatible with the subject device. It also must be understood that the subject device can itself be periodically removed from its position in the fireplace opening for cleaning, inspection, repair and the like of both the insert, per se, and the fireplace compartment, damper, grate, compartment walls, floors, etc.

The opening in question through the lower middle portion of the device is best seen in FIGS. 1, 3, 5 and 7 and is defined by bottom wall 36, side walls 37 and 38 and top wall 39. A rectangular door 40 having handle 41 is hinged at 42 and has heat resistant glass window 43 therewithin. Door 40 closes and abuts against circumferential plates and members 44 to provide a sealed closure therearound. Plate deflector 45 (FIGS. 3 and 5) may be provided integral with top wall 39 or hinged or suspended therefrom and acts to control flow and movement of combustion gases inwardly of the fireplace compartment so that such do not penetrate the passageway defined by walls 36–39, inclusive and excessively heat and smoke up window 43.

The overall housing, including the insert portion 31 and external portion 30, has lower floor plate 46 which underlies the entire lower portion of the device. Outer vertical side wall portions 47 and 48 are strictly parts of the external housing 30 (particular see FIGS. 3, 6, 7 and 8), there being flange side extensions 49 and 50 which extend laterally therefrom from floor 46 well into the height of the upper, greater depth external housing portion 30*a*, so as to, with the aid of fitted installation strips 51 and 52 provide a seal of the fireplace insert device to the walls of the fireplace surrounding the fireplace opening. It should be noted that side walls 47 and 48 deepend considerably in the upper portion thereof at 47*a* and 48*a* (in housing portion 30*a*).

Looking particularly at FIGS. 2 and 6–8, inclusive, the housing walls are recessed inwardly inboard of flanges 49 and 50 to provide vertical walls 53 and 54 which are bottomed by base 46 and topped by wall 55. Insulation seals 51 and 52 have inward extensions thereof which run the height of walls 53 and 54 and seal such to fireplace wall 24 and 25. The portion of the subject device now being described is the internal, inwardly fitting part thereof which is received immediately inside the fireplace opening under wall 26 and opposite the outer portions of walls 24 and 25.

Figure 3:
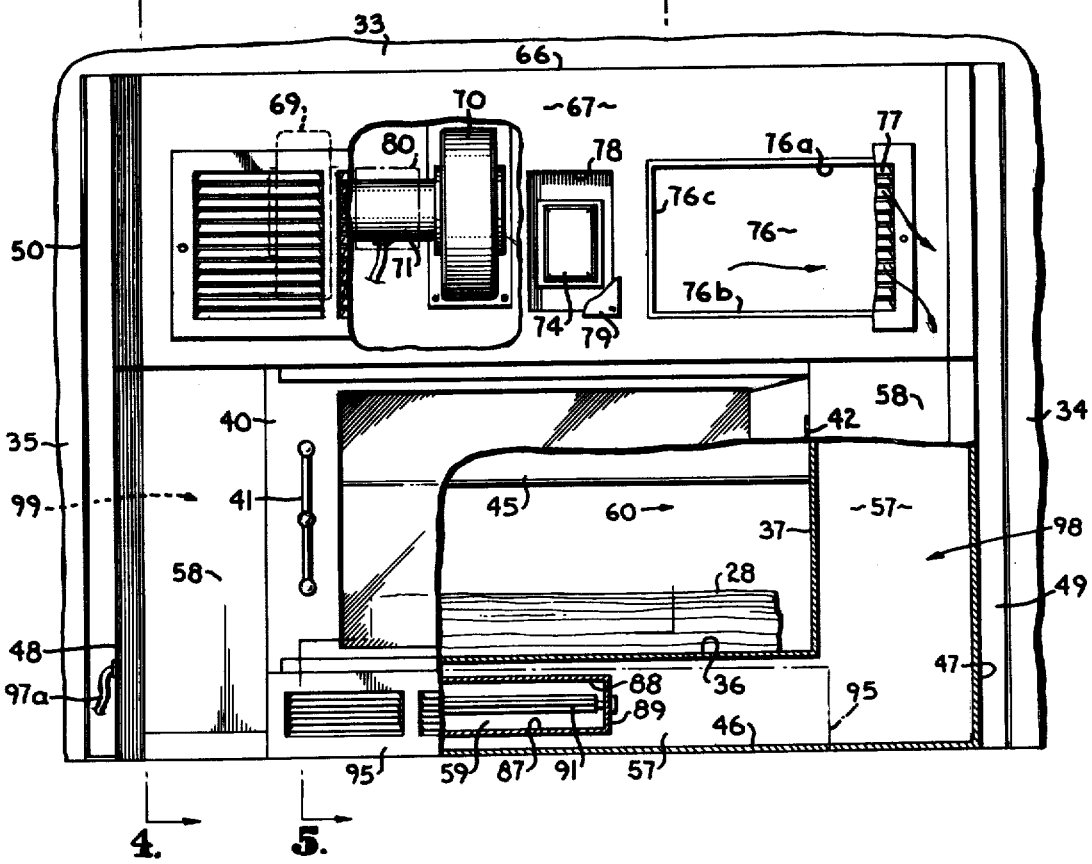
FIG. 3 is an enlarged, front view of the fireplace insert of FIGS. 1 and 2 with parts cut away to better show certain internal constructions and structure of the device in question.
Figure 4:
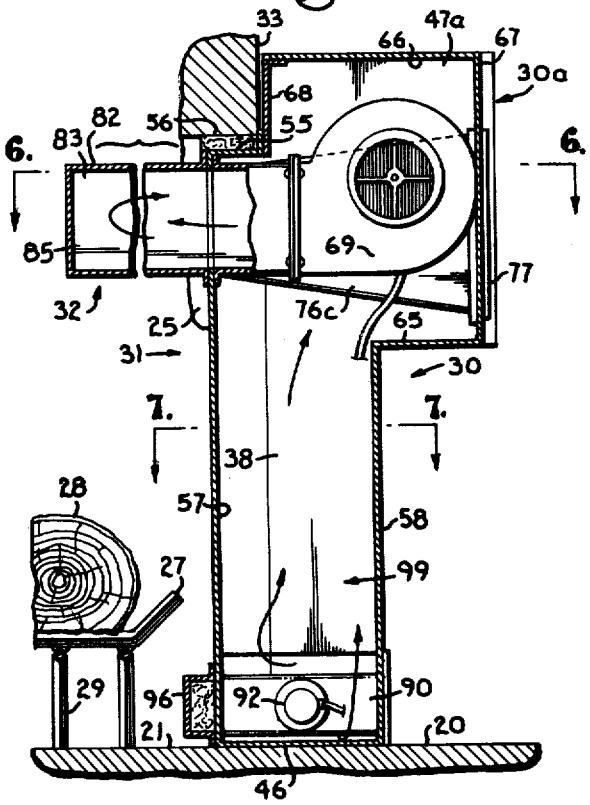
FIG. 4 is a view taken along the line 4—4 in FIG. 3 in the direction of the arrows.
Figure 5:
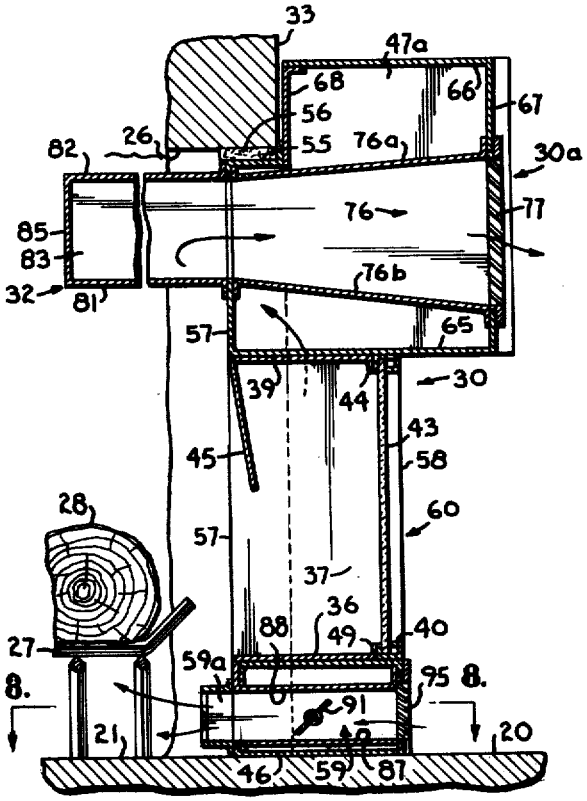
FIG. 5 is a view taken along the line 5—5 of FIG. 3 in the direction of the arrows.

Particularly referring to FIGS. 4 and 5, it can be seen that the upper wall 55 of the inward portion 31 is sealed by horizontal insulation strip 56 (in application of the device into the fireplace opening) analogous to the vertical insulation strip seals 51 and 52 and joining same at the ends of each thereof. The innermost wall 57 (which runs the height of the insert portion 31) may be seen in cutaway in the lower part of FIG. 3, in FIG. 4 in vertical section and in FIGS. 6–8, inclusive at three levels of horizontal section. This wall (as is the lower outer portion 30 outermost wall 58) is penetrated and interrupted at the lowest level (FIGS. 5 and 8) by the air inlet passage 59 to be described then, intermediate the height thereof (particularly see FIGS. 3, 5 and 7), by the main central opening (here now designated 60) defined by walls 36–39, inclusive and, at the uppermost portion thereof, by three openings therethrough (particularly see FIGS. 4, 5 and 6) 61 and 62 (for the blowers to be described) and 63 (for the outlet passage from the plenum to be described).

The upper enlarged or deeper housing portion 30*a* has a lower floor 65 (FIGS. 4–6, inclusive) and an upper wall 66. These walls are bounded outwardly by front vertical wall 67, upper rear vertical wall 68 (FIGS. 4 and 5) and lower rear vertical wall 57. This upper enlarged housing portion, then, is an enlarged, outwardly (with respect to the fireplace) extending chamber which receives therewithin a number of functional elements. These will now be described.

Paired blowers 69 and 70, driven by motor 71, are connected to and mounted on ducts 72 and 73 which discharge through and are fixed around openings 61 and 62 in wall 57. Fan and limit control 74 has sensor probe 75 extending into the plenum chamber currently designated 32 through an opening in wall 57. Air discharge passage 76 is defined by horizontal top and bottom walls 76*a* and 76*b*, as well as vertical side walls 76*c* and 76*d*. This passageway and the walls defining it extend between walls 57 (inboard) and 67 (outboard) and are fixed thereto around openings therein. A grill 77 covers the discharge end of duct or passage 76 and is part of a full grill construction (also 77) which preferably extends across the entire front wall 67 of deep upper housing portion 30*a*.

It is important to note that the only openings provided through front wall 67 are the passage 76, small opening 78 next thereto (normally closed by plate 79) which gives access to control 74 and small motor ventilation opening 80 which permits air to be drawn into the upper housing portion 30*a* to cool blower motor 71. The grill 77 (generally so numbered across the entire front face 67) thus is, to a considerable extent, decorative and must be removed in order to give access to plate 79, as well as the interior of passage 76.

Figure 6:
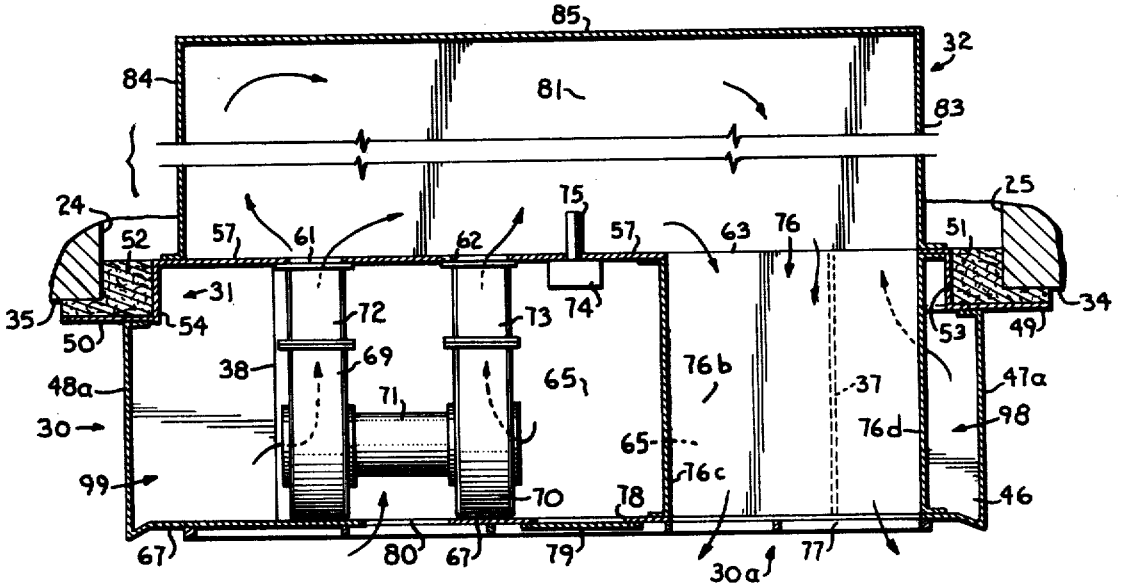
FIG. 6 is a view taken along the line 6—6 of FIG. 4 in the direction of the arrows.

The plenum chamber generally designated 32 is fixed to the wall 57 in a manner seen in detail in FIGS. 10 and 11 and later to be described and has bottom wall 81, top wall 82, side walls 83 and 84 and inner end wall 85. FIGS. 4–6, inclusive show the plenum chamber 32 mounted on wall 57 by flanges (unnumbered) for simplicity of schematic illustration. This mounting may be employed with welding, bracing or rivets used to make the connection. However, it is most preferred to provide the plenum chamber in removable connection with the rest of the housing so that the respective parts of the device may be more readily and separately stored and, more importantly, different size plenum chambers may be employed with a given basic housing structure (and vice versa).

Looking at the lower portion (FIGS. 3–5, inclusive and 8) of the housing or construction, as previously mentioned, there is provided combustion air supply passage 59 in the lower center portion of the housing below main opening 60 through the center of the housing. This passage is defined by lower wall 87, upper wall 88 and side walls 89 and 90. Damper blade 91 is pivotally mounted in passage 59 on a shaft received between walls 89 and 90 and is driven by conventional electric motor 92. It must be noted that passage 59 is the only opening which connects the room space to the fireplace chamber through wall 57, save for large opening or passage 60 which is normally closed by door 40. Said otherwise, the only access of combustion air to the fireplace chamber to burn the wood or other fuel 28 therein is through passage 59, the quantity of flow of this air being controlled by the position of damper 91.

Figure 8:
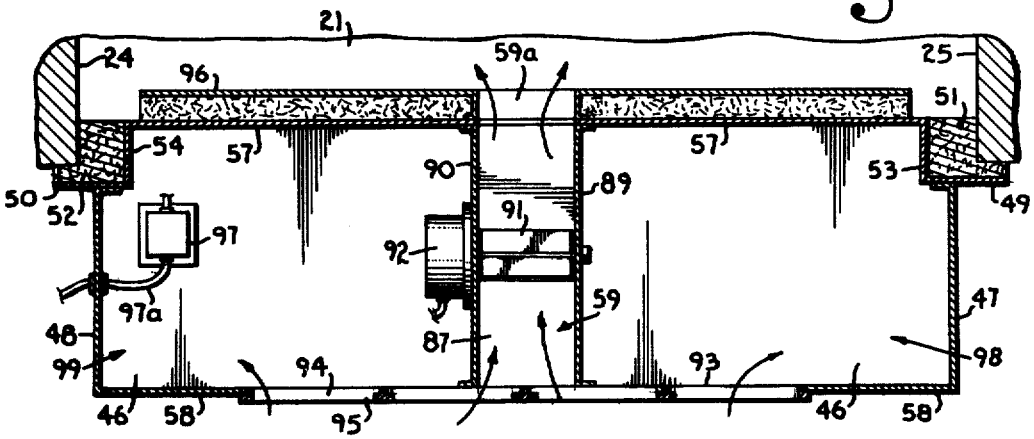
FIG. 8 is a view taken along the line 8—8 of FIG. 5 in the direction of the arrows.

As may be seen in FIG. 8, there are openings provided into the lower front wall 58 on each side of passageway 59 at 93 (right side thereof) and 94 (left side thereof). These openings are best seen in FIG. 8 and are covered by grill 98 which also overlies the outboard opening in the passage 59.

At the base of wall 57, on the inboard side thereof, there is provided an insulation filled channel 96 through which an extension of passage 59 extends at 59*a* (FIGS. 5 and 8). The purpose of this channel is to prevent smoldering embers and hot ash from contacting the base of the housing on the inboard side thereof whereby to give protection to the housing. Also positioned within the lower portion of the housing is transformer 97 which is mounted on floor 46 and is connected to the basic power source by electrical cord 97*a*.

The basic structure of the housing and its attachments having been described above in detail, the manner of its function and the air flow therethrough (both combustion air flow to the fire and within the fireplace and the air flow to the housing for heating of the dwelling or room air space housing the fireplace) may now be described. From the above description it may be seen that a framing housing has been provided to entirely block or close off the conventional fireplace opening. The framing housing has the purpose of providing:

(1) A complete closure for the fireplace chamber opening;

(2) A limited, dampered channel through the lower portion thereof for combustion air flow into the fireplace chamber;

(3) A much larger, normally closed, yet openable passageway through the housing for putting fuel into the fireplace chamber, removing ashes and materials therefrom, etc.;

(4) The provision of air driving means within the housing and air flow passage thereinto, therethrough and there-out-of for intake of ambient air from the dwelling space containing the fireplace and discharge of such air (after heating) back thereinto; and (5) A plenum housing within the fireplace chamber or vault itself to absorb heat and receive the room air therewithin to pick up such heat and enable it to be transferred back into the dwelling space.

The details of this system now will be described with respect to air flow, particularly.

OPERATION

It is assumed that the internal fireplace is clean and fresh fuel is positioned on the grate 27. A gas jet firestarter may be present or paper and/or kindling may be provided for initial lighting of the fire. In order to initially clean out the fireplace and place fuel and any firestarting materials such as paper and kindling therewithin, door 40 is opened and the operator or user of the fireplace inserts such materials inwardly through passage 60. Once the materials are prepared on the grate and the paper ignited (or the gas starter ignited), door 40 is closed.

Prior to this, indeed, during the initial application or installation of the subject insert into the fireplace, per se, the damper at the top of the fireplace in the flue passage has been opened to its full or optimally adjusted position for fire operation. This damper is, once the insert device is placed in the fireplace, left open in the said optimum predetermined position. That is, the closure of the fireplace opening by the insert device substitutes for the normal damper closure, which damper is thus left open so long as the fireplace insert is in place. On the other hand, for fire starting purposes, the damper blade 91 should be in fully open position as seen in FIG. 3. This permits the fireplace draft to be set up and combustion to begin and continue in the fireplace. The damper 91 control is normally set and adjusted in a manner to be described with respect to the heating control process, but, if manual operation were to take place, it would be manually set at full open.

Thus, with the flue damper open and the passage 59 damper 91 open, fire combustion can take place within the fireplace chamber, with the combustion products and smoke going up the flue after impacting on the underside 81 of plenum chamber 32 and going up around the side and inboard wall (83–85, inclusive) peripheries thereof. It thus can be seen that the normal, wide open fireplace chamber with its usual wide open, frontal air passage is replaced by the severely limited intake passage 59, a limited free access around the plenum chamber 32 and then full flue access up the chimney.

Turning now to the means and structure for circulating ambient dwelling or room air through the housing and the plenum chamber 32 in order to heat such air from fireplace combustion, it is particularly noted that the plenum chamber 32 is provided of such size and configuration as to essentially and substantially block off or overlie the entire top portion of the fireplace chamber at the underside of flue passage 23. In the event that the fireplace chamber is particularly configured (for example, reduced width moving into the fireplace chamber), the plenum chamber is preferably so configured as to be essentially congruent therewith, whereby to leave but a substantially uniform, relatively small, peripheral clearance therearound for air, combustion gases and smoke to pass by the plenum chamber. Because of the mounting seen in FIGS. 10 and 11, to be described, plenum chambers can be tailored to fit unusually sized or shaped fireplace chamber configurations.

It is also most important that the plenum chamber not be in the form of one or more conduits where there is any relief or opening(s) centrally of or through the body of the plenum chamber. That is, it is particularly intended and desired (and required by the structure provided) that, not only the air flow into, through and out of the fireplace chamber able to be controlled and lessened from conventional practice but, additionally, that the substantial entire heat of the fire be required to impact upon the bottom wall 81 of chamber 32 and, to a lesser extent, the sides walls 83 and 84 and end wall 85. In order to additionally maximize this effect, the plenum chamber is attached closely adjacent the top of the inwardly fitted portion 31 of the housing, with portions of wall 57 therebelow and deflector or reflector 45 additionally provided to minimize combustion gas flow and heat passage into the annulus or opening 60.

The annular clearance around the plenum chamber 32 with respect to rear wall 23 and side walls 24 and 25 of the fireplace is preferably in the range of one half inch to three inches, optimally one to two inches. This gap has been exaggerated for illustrative purposes in the showing of FIG. 6, that is, the relative gap between wall 25 and wall 83 or wall 24 and wall 84 with respect to the fireplace side walls and plenum side walls. To repeat, the severely restricted dimension of passage 59 as compared to the usually entirely open front fireplace chamber opening defined in walls 33–35, inclusive, the restricted annulus around plenum chamber 32 and any dampering of passage 59 may greatly restrict the conventional flow of air with respect to a fireplace and thus rigorously and precisely control combustion within the fireplace in a manner which greatly conserves fuel. Said otherwise, the fire, when damper controlled at 91, cannot burn at its own maximum rate, rather it may be restricted to burn at a considerably lesser rate than normal, such controlled.

Figure 7:
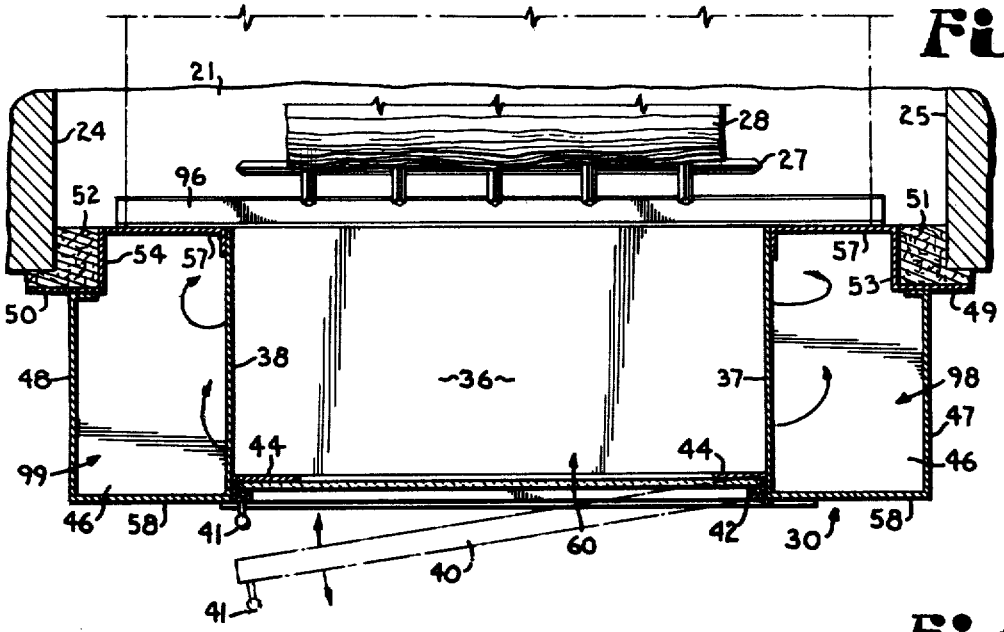
FIG. 7 is a view taken along the line 7—7 of FIG. 4 in the direction of the arrows.

From the showings of FIGS. 7 and 8, which are horizontal sections taken through the lower, lesser thickness portion 30 of the housing, it can be seen that portions of the housing, particularly including reduced width side wall portions 53 and 54 and rear wall 57, are somewhat in the fireplace chamber and, wall 57, particularly, as well as the lower wall portions of opening 60, are exposed to the heat of combustion within the fireplace. It is important that this heat, which builds up particularly in the noted directly exposed portions, be utilized in initially warming the room air which is desired to be heated by circulation through the subject device. Accordingly, except for the quite small (optional) opening 80 provided in front wall 67 to permit the limited inward drawing of ambient air solely to cool blower motor 71, air circulated within the housing enters solely through openings 93 and 94 at the bottom of the front face or wall 58 of the housing. Such air passes through grill 95 and into the space below the lower wall 36 of passageway or opening 60, as well as into the lower inward portions of the side channels 98 and 99 which are defined, above the passage 60 lower wall 36, by outermost side walls 47 and 48, innermost side walls 37 and 38 (of passage 60) and front wall 58 and rear wall 57. Each of these passages, as may be particularly seen in FIG. 4 (passage 99) and FIG. 6, as well as the right hand side of FIG. 3, run the height of the lesser depth housing portion 30 and discharge into the lower inboard portion of the greater depth housing portion **30*a* next lower blower 69 on the left hand side of FIGS. 3 and 6 and under and also slightly to the right hand side of discharge duct 76 on the right hand side of these views. (It should here be noted that the blower positions may be adjusted on wall 57 as well as the position of passage 76** with respect to use of different width plenum chambers with a given housing structure.)

Opening 80 may be placed (if provided) on the underside of the upper portion **30*a*** of the device housing.

The only place for the air drawn through grating 95 into openings 93 and 94 to go is into the intake of blowers 69 and 70 and then through openings 61 and 62 into the left hand side (views of FIGS. 3 and 6) of plenum chamber 32. Thereafter, the only place that such air, which has been heated by wall contact in the ducts 98 and 99 in the housing, as well as particularly in plenum chamber 32, is out duct 76 and thence through grating 77 back into the dwelling or room space.

In considering the heating of the air before it passes into the plenum chamber 32, it should be understood that the inner walls 36–39, inclusive of opening 60 are heated, at least by radiation and contact with wall 57, and thus these walls, as well as wall 57, add to the heating of the room air which is passed through the blower 69 and 70 into the heat exchanging plenum 32. In this manner, the maximum quantity of heat is transferred into the air which is passed through the housing. Accordingly, the maximum total heat transfer to the ambient dwelling or room air is achieved by the overall structure and function of the subject device.

Remarks also may be made with respect to the action of the air flow in the fireplace chamber with respect to the restriction and localizing of the inlet draft in passage 59, as well as the outlet draft (from the fireplace chamber) peripheral to the plenum chamber. There should be no impression whatsoever that there is any failure or impedance of combustion circulation flow by the guiding, limiting and directing of the combustion draft. This is because the draft at the fireplace is created by the draw from the chimney on the flue 23. Thus, if there is an effective chimney draw initially present, this draw remains and is not effected by the presence of the fireplace insert or its channeling of the airflow. Indeed, the positioning of the inlet flow passageway 59, as it is, centrally and low on the insert frame, whereby to feed air centrally and low in the fireplace chamber, optimizes the combustion process itself. Thus, once the basic chimney draw is regulated by adjusting the conventional damper in flue 23 above the fireplace chamber to the optimum opening, then adequate and sufficient quantities of combustion air are readily provided through passageway 59 alone. Such air is directed optimally in the fireplace for most effective and efficient combustion. This passageway required damper control in order to properly control the combustion in the fireplace.

FIG. 9 CIRCUIT DIAGRAM

Figure 9:
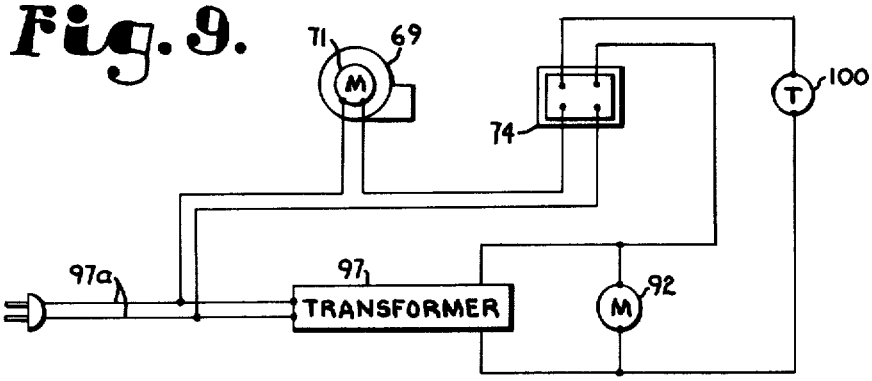
FIG. 9 is a schematic electrical diagram of the power driven and control elements of the device.

In FIG. 9, there is shown a schematic electrical circuit diagram for the subject system. The electrical elements in the circuit include transformer 97, damper control motor 92, room thermostat 100, fan and limit control 74 and blower motor 71. The power line to the conventional 110 volt AC source is seen at **97*a*. The room thermostat 100 and damper motor 92 are connected to the limit side of the fan and limit control 74 with the blower motor 71 connection being to the opposite side thereof. The power connections from transformer 97 to the limit side of fan and limit control 74** are preferably 24 volt with the connections to the transformer and from the fan side of the fan and limit control being 110 volt.

It should be noted that the transformer and the damper motor may be mounted on either side of passageway 59. Typical commercial apparatus elements could include: (1) damper motor 92 a White Rogers model 1361-102, (2) transformer 97, a 24 volt Honeywell model AT72D1683, (3) fan and limit control 94 a Honeywell model L4064B and (4) the dual fan blower 71 a Dayton Model 2C069B. These are common, commercial, off the shelf items.

Figure 10:
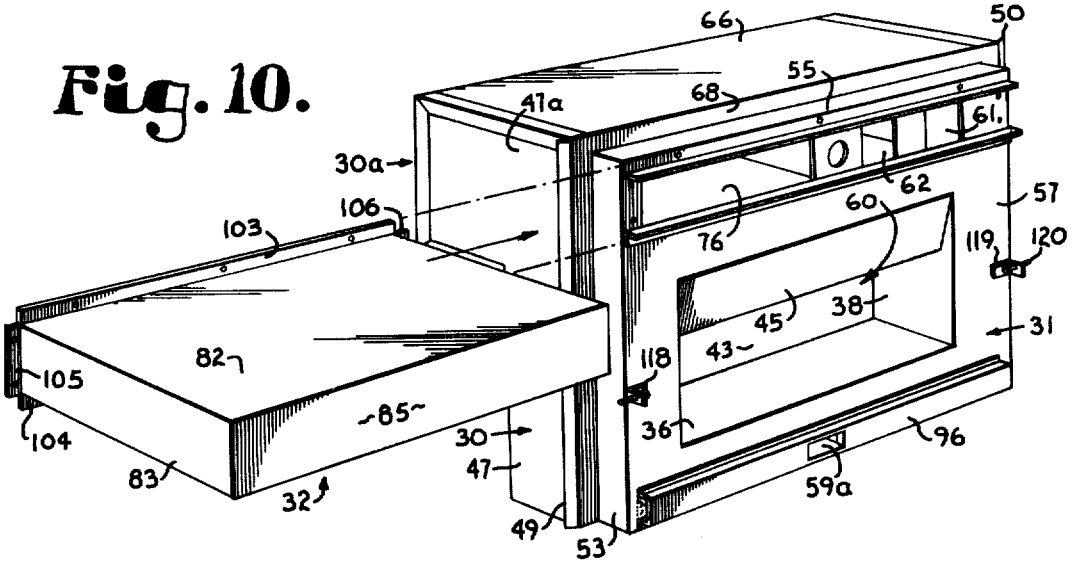
FIG. 10 is a three quarter perspective view of the rear end of the device taken slightly from above with the plenum construction of the device which is received within the fireplace chamber or compartment shown removed therefrom.
Figure 11:
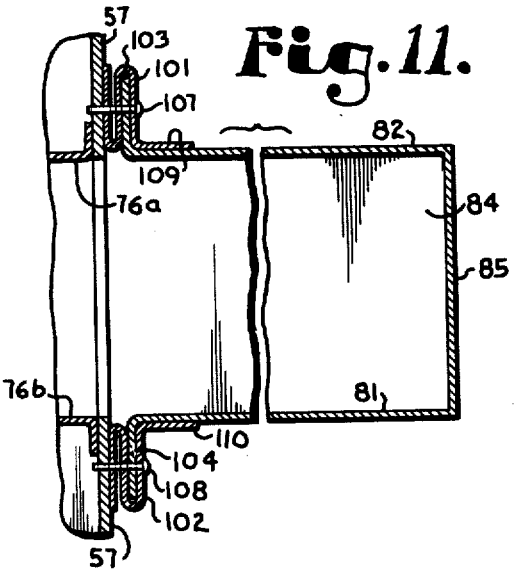
FIG. 11 is a sectional view taken through a portion of the upper back wall of the device of FIG. 10 (at the first screw connection on the left hand side of the view of FIG. 10) showing the manner of removable engagement of the plenum housing or chamber with the outer device housing which overlies the fireplace opening.

FIGS. 10 And 11

These views detail the preferred mode of mounting and attachment (removable) of the plenum chamber 32 to the inboard side of the upper housing portion **30(*a*). It also gives a rear or inboard three-quarter perspective view of the insert, viewed, as it were, from inside the fireplace chamber. In this view, parts already described, will be numbered the same as in FIGS. 1–9**, inclusive and not be redescribed. Only the differing attachments from such seen in those previous views will be described in detail, with the one additional exception of the locating bolts and their long mountings which will also be described.

Referring, then, to FIGS. 10 and 11, a pair of horizontally mounted S section channels 101 (upper) and 102 (lower) are fixed to the inboard wall 57 of the reduced size inward portion 31 of the housing, in parallel relationship. These channels, tracks or mountings 101 and 102 frame, above and below, openings 61, 62 and 76 (passage 76) in wall 57. The plenum box or chamber 32 defined by walls 81-85, inclusive, is provided with upper and lower flanges 103 and 104, respectively, as well as side flanges 105 and 106, each such flange 103-106, inclusive having suitable bolt holes therethrough adapted to align with congruently spaced bolt holes through the S channels 101 and 102, as well as openings at the side edges of wall 57 within the channel track. Bolts or screws as seen at 107 and 108 in FIG. 11 (engaging upper and lower flanges 103 and 104 to channels 101 and 102) are provided to removably fix the plenum box and chamber with respect to the inboard side of portion 31 of the housing. As previously mentioned, in order to be able to provide plenum chamber boxes of, for example, somewhat or substantially lesser width than housing portion 31 for adaptation to a lesser width fireplace chamber, the openings 61, 62 and 76 must be positioned sufficiently inboard of the edges of wall 57 to permit such adjustment. The bolt openings, in such case, do not need to be changed as the flange sizes can be varied on the plenum boxes.

To insert a given plenum box on a given housing, the plenum box is positioned as in FIG. 10 and then moves to the right to make the flange-channel engagement seen in FIG. 11. The bolt openings must be aligned and, when this is done, screws or bolts as at 107 and 108 are emplaced in the various openings engaging the upper and lower flanges 103 and 104 in the channels 101 and 102 and the side flanges 105 and 106 against wall 57 at the peripheries thereof between the channels 101 and 102. To remove the particular plenum box, the bolts or screws are removed and the box slid laterally out of its channel engagement. Preferably, supportive flanges 109 and 110 are provided inboard of the S section engaging flanges 101 and 102 to provide extremely strong and stable support for the plenum box 32 with respect to the housing 31.

Optionally, but perferably, angle flanges 118 and 119 are fixed to the inboard face of wall 57 intermediate the height thereof whereby to provide position fixing bolts 120 which will screw therethrough and aid in fixing the position of the housing within the fireplace chamber or well. More than one such angle flange and bolt may be provided on each side. Such should be positioned sufficiently low on the wall 57 for ready access through opening 60. When deflector flange 45 is hinged mounted, such may be positioned higher on the wall 57, as well as lower.

Figure 12:
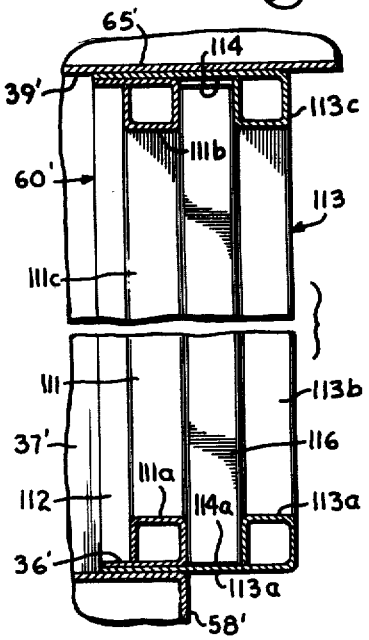
FIG. 12 is an enlarged detail of a preferred door construction (in contrast to that door construction particularly seen and illustrated as an option in FIGS. 1, 3, 5 and 7), this view taken in section analogous to the corresponding part of the view (lower right center) of FIG. 5.
Figure 13:
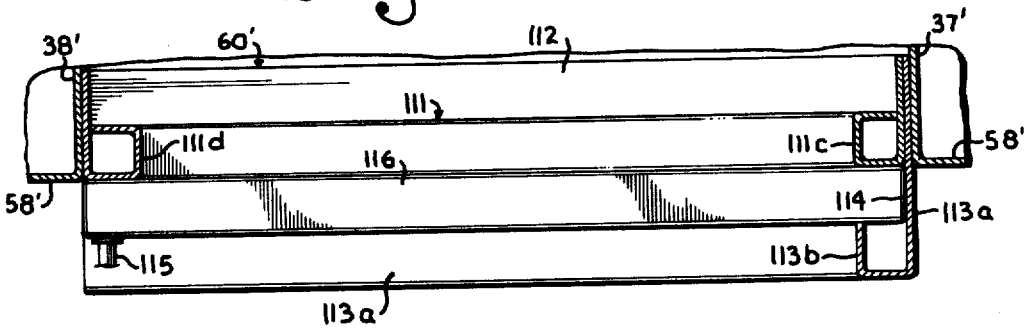
FIG. 13 is a top view of the door construction of FIG. 12 taken from the top of the door at a position just above the section line 7—7 of FIG. 4 (or just under the enlarged housing portion at the top of the device).

FIGS. 12 And 13

In this view, there is seen and illustrated the preferred form of door construction utilized in the subject fireplace insert. FIG. 12 is a fragmentary enlarged view showing a portion of the device in section analogous to a portion of FIG. 5. That is, this view will correspond to the lower right center of the portion of the view of FIG. 5 showing the door closure on the outer or outboard portion of passage or opening 60 in the housing portion 30, just under the deeper enlarged section 30*a* of the housing. Accordingly, corresponding parts of the structure identical or analogous to the structure of FIGS. 1-9, inclusive, are numbered the same, but primed.

It is also noted that this door construction is also seen from the front and end views in FIGS. 14 and 15. The view of FIG. 13 is a top view of the door construction taken from the top of the door at a position just above the section line 7—7 of FIG. 4 or just under the enlarged housing portion 30*a* at the top of the device, as previously noted.

Looking particularly at FIGS. 12 and 13, a closed channel generally designated 111 has bottom and top portions 111*a* and 111*b*, respectively, as well as side vertical portions 111*c* and 111*d*. This channel is mounted on integral inwardly extending flange 112, such flange being mounted within opening 60 over the inboard flange 113*a* of the outer channel (generally designated 113) on the top, bottom and one side, specifically, with respect to the latter, the right hand side in FIG. 13.

The outer channel, generally designated 113, which, together with channel 111, forms a track 114 therebetween, has but three sides, specifically, bottom portion 113*a*, vertical end portion (right hand side of FIG. 13) 113*b* and top portion 113*c*. The left hand end of channel 113 is relieved so that the handle 115 (best seen in FIGS. 14 and 15) of sliding door element 116 may move through the channel frame opposite and past channel 111*d* of the inner channel 111. Door 116 is a four sided frame of which the left end is seen in FIG. 12, the top is seen in FIG. 13, the left end seen in FIGS. 14 and 15 and the glass window 117 thereof seen in FIG. 14. This door is essentially the same or analogous in structure to the door seen in FIGS. 1-9, inclusive except it is not hingedly mounted on the frame, or housing, but, rather, slidingly mounted in the trackway 114 provided by the channels 111 and 113. As can be seen particularly from FIGS. 12, 13 and 15, channel 111 is fully received within passageway 60′ whereby door 116 slides closely across the front wall 58′ to open.

While either form of door specifically disclosed in this application is useful, the door 116 is particularly of utility because it can be readily entirely removed from and fitted back into the trackway 114 for cleaning of the inside surface of the door at a point removed from the fireplace.

FIGS. 14-17, Inclusive

The purpose of this set of drawings, in addition to further illustrating the preferred door construction of FIGS. 12 and 13, is primarily to illustrate a preferred manner of drawing air into the housing of the subject fireplace insert device. Specifically, that is, rather than draw air into the front of the housing through lower openings 93 and 94, through grill 95 as seen in FIG. 8, openings are instead provided in the side walls of the lower portion of the housing. This, as well as the door construction, as noted, is the purpose of these figures and, therefore, the other parts being identical (except as previously described with respect to FIGS. 12 and 13), such will be numbered the same as in FIGS. 1-9, inclusive, but primed. Such identical parts will not again be described. Additionally, it should be noted that a minimum number of parts are shown in the cutaway views in order to particularly illustrate only the differences between the construction of FIGS. 14-17, inclusive and that of FIGS. 1-9, inclusive.

The changes in question are particularly evident in FIGS. 16 and 17 with respect to the input flow of air into the lower portion of the housing and the vertical side legs thereof on each side of the housing central opening or passage 60′. It may be seen that grills 121 and 122 are provided on the outboard side walls 47′ and 48′ at the lower portions thereof. These grills are received in and over openings 123 and 124, respectively, which run the substantial height of at least the lower grill openings shown in the views and optimally into or up the entire height of the second grill opening. Alternatively, the left hand grill in the view of FIG. 14, specifically, 122, may be of lesser opening size than the grill opening for the right hand grill 121.

There is provided, at the bottom of vertical channel 93', in the right hand vertical leg of the lower frame portion 31' an optional closure plate 125 which closes off the entire lower end of vertical passageway or channel 98'. The purpose of this closure plate 125 is to require that there be some input air flow into the lower portion of the housing under floor 36' of passageway 60', thus to cool motor 92' and the transformer 97 (FIG. 8). This low is indicated by arrow 126. The input air flow thereabove through grill 121 is indicated by arrow 127. The input air flow through grill 122 is indicated by arrow 128.

Thus, it may be seen that air drawn in through grill 121 is divided between the flow up channel 98' and flow under floor 36' and plate 36' ultimately up channel 99'. All air into grill 122 goes up channel 99'. The air flow dynamics in housing portion 30a' and plenum box 32' remains the same.

GENERAL DESCRIPTION OF THE STRUCTURE

Reviewing the construction in question in view of the foregoing description and before the detailed description of operation of the control system, the following may be noted. This is a fireplace control and heat exchanging unit adapted to be mounted as an assembled unit into and in front of the fire receiving recess of a pre-existing fireplace. With respect to the latter there is normally a substantially horizontal fireplace hearth 20. A normally substantially vertical fireplace front wall 33 extends upwardly from the hearth 20, there being a normally substantially rectangular opening provided in the front wall 33–35, inclusive.

A fire receiving recess, opening or space leads rearwardly from the said front wall opening and is surrounded by the front wall. There are normally provided vertical, opposed side edges in the front wall and a normally horizontal lintel thereabove (at 26) defining the opening and the outboard front portion of the recess or fireplace.

The recess itself typically has an inwardly extending, normally horizontal floor 21 comprising an extension of hearth 20, with two normally substantially vertical side walls 24 and 25 extending inwards from the fireplace front wall side edges at substantial right angles thereto. Alternatively, the last mentioned walls 24 and 25 may converge inwardly somewhat as they move away from the recess opening. There is also present a rear wall 22 and a top wall 26.

A flue 23 with a damper control conventionally placed therewithin (not seen in the drawings) extends upwardly from at least a portion of the top wall of the recess or fireplace space in order to carry off smoke and the combustion products of the fire. It should be noted that conventional variations in position and form of bottom, side, top and rear walls, as well as flue construction (and the damper structure provided therewithin) should be considered as included in and contemplated by the disclosure of this application.

The fireplace control and heat exchanging unit itself typically comprises, in combination:

(1) a first, substantially rectangular, relatively shallow, vertical, hollow insert housing portion adapted to fairly closely but removably fit into the fireplace front opening and be received within the outboard portion of the fireplace recess or space in a manner where said first housing portion somewhat or substantially congruently fills said opening and an outboard portion of said recess. This engagement is well seen in the essential center of FIG. 2, as well as FIGS 4–8, inclusive. Note FIG. 10 which shows the said inner housing portion looking at the assembly from the rear with the plenum chamber 32 removed therefrom.

(2) The first housing portion is defined by a rear, inboard wall 57 and bottom (46), top (55) and side walls (53 and 54) connected to one another to make a substantially rectangular insert with an open outboard face.

(3) A second, relatively deeper, largely hollow, rectangular external housing portion is fixed to the outboard end of the first housing portion integral therewith. This is generally designated 30 and 30a. The second housing portion comprises in its lower part or portion 30 a substantial extension outward of the first housing portion. It also includes an upward extension 30a thereof substantially above the first housing portion lower part whereby, when the first insert housing portion 31 is inserted into the outboard portion of the fireplace recess, the lower inboard part of the second housing portion lies at least substantially adjacent the fireplace front wall side edges while the inboard part of the upward extension thereof approaches and extends above the lintel overlying the fireplace opening.

(4) The second housing portion has a bottom wall (46 extended), side walls (47a and 48a), a top wall (66) and upper and lower front walls 67 and 58. The bottom, side and top walls noted are connected, by suitable continuous wall members, with the respective bottom, side and top walls of the said first housing portion.

(5) Thus it may be seen that the first and second housing portions together define and provide a single, hollow, sealed housing adapted to fit partly within (the first housing portion) and partly outside (the second housing portion) said fireplace opening and recess.

(6) Flange means 49 and 50 are provided laterally of the outboard edges of the first housing portion side walls and the inboard edges of the second housing portion side walls so as to overlie, in substantial contact, the entire height of the fireplace front opening side walls. By these means, in combination with the partial upper rear wall of the second housing portion, which lies against the lintel of the fireplace, the fireplace recess and front opening thereof are substantially completely closed off when the insert is in place.

Having closed off the opening as noted, it is necessary to give access thereto for inputting fuel to the fireplace recess, cleaning ashes and the debris of fires therefrom and, further, for input of damper controlled air to permit the combustion process.

(7) A substantially horizontal, substantially central fuel feed opening passageway 60 through the first and second housing portions 30, 31 is defined by a first circumferential wall 36–39, inclusive extending entirely through both of the said housing portions, said wall, at its inboard and outboard ends, continuously and circumferentially fixed to the first housing portion rear wall 57 and the second housing portion lower front wall 58, respectively, said opening and passageway spaced inwardly away from the bottom, top and side walls of said first and second housing portion.

(8) A door closure 40, 41, 42 (or 115, 116 in FIGS. 12 and 13) for the central opening and passageway is provided on the outside wall of the second housing portion in the lower intermediate portion thereof. This door closure is opened only for fueling and cleaning out the fireplace after use and it remains closed at all times during combustion.

(9) For combustion air, a substantially horizontal, lower draft opening and passageway 87–90, inclusive defined by a second circumferential wall extends entirely through said first and second housing portions below the central fuel feed opening 60 and passageway thereof, there being draft control means 91, 92 associated therewith.

(10) An intake opening is provided in the lower part of the second housing portion for receiving air from outside the housing thereinto.

OPERATIONAL CONTROL

With respect to the operational control of the subject system, there are two basic controls. First of these is the thermostat control which has to do with the opening and closing of the damper blade 91. Second is the fan and limit control which has some damper blade 91 control and also operational control of fans 69 and 70. It is most important to note that there is a separate thermostat in this control system, thermostat 100, entirely independent of the housing or dwelling thermostat which is connected to the heating unit or furnace of the house. Thus, the control system of FIG. 9 is a closed and self sufficient control system solely for this heat-exchanging fireplace insert.

Turning to the operation of the system of FIG. 9 as applied to the subject device, with respect to the fireplace insert thermostat 100 control, any time it is set by the operator to a temperature above the room temperature in which thermostat 100 is located, damper blade 91 is opened. Any time the operator sets thermostat 100 to a temperature below the room temperature in which thermostat 100 is located, damper blade 91 is closed, thus shutting off air flow in passage 59.

With respect to the fan and limit control 74, this has three settings. The first (high) setting is between 150° and 170° F. As may be seen from FIG. 6, as well as FIG. 3, the fan and limit control has sensor 75 which protrudes into the plenum chamber 32. With respect to the high limit control setting, when the temperature in the plenum box 32, as sensed by element 75, reaches this heat level and limit, damper 91 is shut off. This action is independent of whether or not the room temperature where the thermostat 100 is located is below the thermostat setting. Said otherwise, the top limit control noted overrides the thermostat setting.

The second setting of the fan and limit control is between 80° and 130° F., typically at 120° F. When this temperature level or setting is reached, the fans 69 and 70 are turned on. That is, when a heat buildup begins to take place in the plenum chamber 32 due to the existence of a fire below, at the noted second limit control setting or temperature level, the blowers 69 and 70 are turned on so as to move the hot air in plenum chamber 32 out into the room and, also, bring cool air into the plenum box 32 in active circulation for heating.

The third setting of the fan and limit control is approximately at 85° F. or lower. That is, when the temperature in plenum box 32 drops to this setting at 85° F. or whatever particular setting is made, the blowers 69 and 70 are shut off. The purpose of this is to prevent cool air from being circulated through or into the room having the fireplace (or insufficiently heated air).

FIG. 18

This fragmentary showing is presented to illustrate a construction of the subject heat exchanging fireplace insert where the portion of the housing that is received within the fireplace recess is of equal width to the external housing portion. Said otherwise, the first housing portion, seen at 53 and 54 in FIGS. 6–8, inclusive, is not of lesser width as seen in those views, but rather equal in width to the second external housing portion **30, 30*a***.

Figure 18:
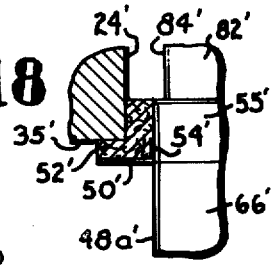
FIG. 18 is a fragmentary top elevation of a preferred variation of structure of the fireplace insert at its fireplace opening engagement.

The view of FIG. 18 is quite analogous to the highest section seen in FIG. 6. That is, it is a fragmentary view taken essentially to the left in FIG. 6 and the outer housing wall **48*a*' is equivalent to wall 48*a*, flange 50' is equivalent to flange 50 and side wall 54' of the first internal housing portion is equivalent to side walls 54. Likewise, the side wall 84' of the plenum chamber 32 is equivalent to wall 84 in FIG. 6**.

This view is essentially taken along a line in FIG. 5 (moving right to left) which runs just above the top wall 66, then drops under the lintel immediately above top wall 55 of the first housing portion and passes thereafter just above the top 82 of the plenum. Accordingly, the numbers of the earlier figures are the same in FIG. 18, but primed.

It should be noted that the options of width of the inner and outer housing portions are three-fold. First is the typical showing of FIGS. 6–8, inclusive (also note FIG. 10). In this the inner housing portion is of slightly lesser width than the outer housing portion. The second option is that seen in FIG. 18 where the two housing portions are of equal width. The third, which is quite unusual, but not impossible, would involve the outer housing portion being of lesser width than the inner housing portion. Any of these options may be employed but the flanges 49 and 50 must overlie the fireplace side walls.

General remarks may very well be here with respect to fireplace shape, insulation and the like. Thus, the insert housing portion is itself typically two to three inches deep. The clearance between the insert and the fireplace recess vertical wall 24 and 25 is typically one to three inches on each side. It is, of course, necessary that the flanges 49 and 50 be of sufficient width so as to overlie the outer faces 34 and 35 of the fireplace recess side walls at least an inch and preferably somewhat more.

Turning to the plenum box 32, the shelving or necking in of the plenum box with respect to the inner housing portion 31 is typically one to three inches, depending upon the configuration of the fireplace inward of the recess. Preferably it is in the lesser amount. However, it should be noted that, if the insert housing portion 31 clearance is one inch on each side and there is a one inch necking in on each side of the plenum box in addition, then there is a minimum lateral annulus around the plenum box of two inches. However, with respect to the latter, many, indeed most, fireplaces taper to the rear somewhat. That is, walls 24 and 25 (FIGS. 6–8, inclusive) are typically not perfectly parallel in their entire extension.

At the other extreme, where there would be, say, two inches clearance on each side with respect to the fireplace insert housing portion and two inches clearance on each side with respect to the plenum box and the latter, there could be, in prefectly parallel fireplace recess walls, a clearance of four inches or more laterally on each side of the plenum box.

With respect to this, it should be noted that the grating holding the firewood is typically not anywhere near the full width of the fireplace and thus the entire fire is going to be under the plenum box anyway. In normal burning of a fire, it tends to roll in and then out, rather than first laterally. A typical clearance at the end of the plenum box to the rear wall of the fireplace recess would be one to three inches. The purpose of the removability of the plenum box as seen in FIG. 10, is to enable the fitting of the preferred, optimum size and shape of plenum box onto the inboard or inward end of the insert portion 31 so as to most efficiently and best fit a given fireplace.

While insulation is shown inboard of the fireplace recess in FIGS. 5–8, inclusive, the key insulation is surrounding the fireplace recess (flanges 49 and 50) and between wall 68 and the lintel wall 33 (not shown).

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

We claim:

1. A fireplace control and heat exchanging unit adapted to be mounted as an assembled unit into and in front of the fire receiving recess of a preexisting fireplace, there being, with respect to the structure of the fireplace, per se, a normally substantially horizontal fireplace hearth, a normally substantially vertical fireplace front wall extending upwardly from said hearth, a normally substantially rectangular opening in said front wall, the fire receiving recess received in said front wall opening and surrounded by said front wall, there being normally vertical, opposed side edges in the front wall and a normally horizontal top lintel thereabove defining said opening and the outboard front portion of said recess, the recess itself normally having an inwardly extending, normally horizontal floor comprising an extension of the hearth, two normally substantially vertical side walls extending inboard from the fireplace front wall side edges at substantial angles thereto, a rear wall and a top wall, there further being a flue with a damper control therein extending upwardly from at least a portion of the top wall of said recess to carry off smoke and the combustion products of a fire, said fireplace control and heat exchanging unit comprising, in combination:

(1) a first, substantially rectangular, relatively shallow, vertical, hollow insert housing portion adapted to fairly closely but removably fit into the fireplace front opening and be received within the outboard portion of said fireplace recess in a manner where said first housing portion somewhat congruently fills said opening, as well as the outboardmost portion of said recess, (2) said first housing portion defined by a rear, inboard wall and bottom, top and side walls connected to one another to make a substantially rectangular insert with an open outboard face, (3) a second, relatively deeper, largely hollow, substantially rectangular external housing portion fixed to the outboard end of said first housing portion and made integral therewith, said second portion comprising in its lower part a substantial outward extension of the first housing portion and also including an upward extension thereof rising substantially above said first housing portion lower part whereby, when said first insert housing portion is inserted into the outboard portion of said fireplace recess, the inboard lower part of said second housing portion lies at least substantially adjacent the fireplace front wall side edges and the inboard part of the upward extension thereof approaches and extends upwardly substantially parallel to the lintel overlying said fireplace opening, (4) said second housing portion having a bottom wall, side walls, a top wall and upper and lower front walls, the said second portion bottom, side and top walls connected, by suitable continuous wall members, with the respective bottom, side and top walls of said first portion, (5) the first and second housing portions together defining and providing a single, hollow, sealed housing adapted to fit partly within and partly outside said fireplace opening and recess, (6) flange means provided laterally of the outboard edges of the first housing portion side walls and the inboard edges of the second housing portion side walls operative to overlie in substantial contact the substantial entire height of said front opening side walls, whereby said fireplace recess and front opening are substantially completely closed off, when said insert is in place, by said housing, flange means and the partial upper rear wall of the second housing portion, (7) a substantially horizontal, substantially central fuel feed and cleanout opening and passageway through said first and second housing portions defined by a first circumferential wall extending entirely through both of said housing portions, said wall, at its inboard and outboard ends, continuously and circumferentially fixed to the first housing portion rear wall and second housing portion lower front wall, respectively, said opening spaced inwardly away from the bottom, top and side walls of said first and second housing portions, (8) a door closure for said central opening and passageway on the lower front wall of said second housing portion, (9) a substantially horizontal lower draft opening and passageway defined by a second circumferential wall extending entirely through said first and second housing portions below said central fuel feed opening and passageway, there being draft control means associated therewith, said second wall fixed to the front housing portion rear wall and second housing portion lower front wall,

(10) an elongate, sealed, monolithic, hollow plenum body defined by top and bottom walls, side walls and a rear wall fixed to the upper rear wall of the first housing portion above the fuel feed and cleanout opening, said plenum body so sized and shaped as to substantially, yet not entirely, block and close off a substantial portion of said fireplace recess under the top wall and flue thereof,

(11) at least two spaced-apart discrete openings through said first housing portion rear wall into said plenum body, one an inlet opening thereinto and the other an outlet opening therefrom,

(12) a blower positioned in the upper part of said housing connected to said first opening and adapted to blow relatively cool air from said housing into said plenum,

(13) a hollow passageway defined by a third circumferential wall positioned in the upper part of said first and second housing portions connected to said first housing portion rear wall around said second opening and adapted to receive therewithin relatively heated air from said plenum body and pass it out of said first and second housing, and

(14) at least one intake opening positioned in the lower part of said second housing portion for receiving air from outside said housing thereinto.

2. A unit as in claim 1 wherein there are two openings into the lower part of said second housing portion for receiving air from outside said housing thereinto, said openings positioned one on each side of the second housing portion side walls adjacent the lower ends thereof.

3. A unit as in claim 2 wherein one of said side wall openings has a horizontal wall closing off the passageway between the central feed and cleanout opening defining first circumferential wall and the second housing portion side wall having said side wall opening therein, said wall closeoff positioned adjacent the upper portion of said passageway but above the lower end of said intake opening.

4. A unit as in claim 1 wherein the intake opening in the lower part of said housing is positioned substantially centrally of the front wall said second housing portion below the central feed opening therein.

5. A device as in claim 1 wherein said hollow passageway connected to said second opening into said plenum body connects with an outlet opening in the upper front wall of the second housing portion.

6. A unit as in claim 1 including an opening into the said second housing portion for inlet of cooling air to said blower.

7. A unit as in claim 1 wherein the upper portion of said second housing portion above said central feed opening is of greater depth than the lower portion of said second housing portion surrounding and below said central feed opening.

8. A unit as in claim 7 wherein said greater depth second housing portion has a substantial portion thereof extending below the lintel of said fireplace opening including a portion thereof opposite and extending below the plenum body.

9. A unit as in claim 1 wherein said plenum body is substantially congruent in form to the shape of the upper fireplace recess, whereby a substantially uniform annulus is provided around the periphery of said plenum body when said insert is in place with respect to said fireplace.

10. A unit as in claim 1 wherein the door for said central feed and cleanout opening is slideably openable in a grooved trackway provided surrounding three sides of said opening, said door removable from said trackway at one end thereof.

11. A unit as in claim 1 wherein said substantially horizontal fuel feed and cleanout opening and passageway is substantially rectangular in shape.

12. A unit as in claim 1 wherein there are three openings through said second housing portion rear wall into said plenum body with blowers connecting to two of said openings.

* * * * *